US011083296B2

(12) United States Patent
Jones

(10) Patent No.: US 11,083,296 B2
(45) Date of Patent: Aug. 10, 2021

(54) TOP ATTACHMENT FOR A LAUNDRY APPLIANCE

(71) Applicant: WHIRLPOOL CORPORATION, Benton Harbor, MI (US)

(72) Inventor: Christopher A. Jones, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/597,118

(22) Filed: Oct. 9, 2019

(65) Prior Publication Data

US 2020/0205569 A1 Jul. 2, 2020

Related U.S. Application Data

(60) Provisional application No. 62/786,095, filed on Dec. 28, 2018.

(51) Int. Cl.

| | |
|---|---|
| ***A47B 96/20*** | (2006.01) |
| ***A47B 96/18*** | (2006.01) |
| ***D06F 39/12*** | (2006.01) |

(52) U.S. Cl.

CPC ..... *A47B 96/20* (2013.01); *A47B 96/18* (2013.01); *D06F 39/12* (2013.01); *A47B 2096/208* (2013.01)

(58) Field of Classification Search

CPC ... A47B 96/20; A47B 96/18; A47B 2096/208; D06F 39/12

See application file for complete search history.

(56) References Cited

U.S. PATENT DOCUMENTS

| | | | | | |
|---|---|---|---|---|---|
| 3,610,175 | A * | 10/1971 | Wilton | A47B 13/08 | 108/161 |
| 3,820,296 | A * | 6/1974 | Bebinger | A47B 96/18 | 52/782.24 |
| 4,073,556 | A * | 2/1978 | Wilson, Jr. | A47B 57/16 | 312/7.2 |
| 4,143,496 | A * | 3/1979 | Destito | E04F 13/088 | 273/282.1 |
| 5,176,435 | A * | 1/1993 | Pipkens | A47B 17/00 | 312/204 |
| 5,249,857 | A * | 10/1993 | Suzuki | A47B 47/042 | 312/249.8 |
| 5,590,500 | A * | 1/1997 | McCue | A47B 96/18 | 52/311.2 |
| 5,941,617 | A * | 8/1999 | Crane, Jr. | B44C 5/04 | 312/204 |

(Continued)

FOREIGN PATENT DOCUMENTS

| | | |
|---|---|---|
| CN | 202559124 U | 11/2012 |
| CN | 204825390 U | 12/2015 |

(Continued)

*Primary Examiner* — Hanh V Tran

(74) *Attorney, Agent, or Firm* — Price Heneveld LLP

(57) ABSTRACT

A laundry appliance includes a cabinet including a top edge. A structural panel is attached to the top edge of the cabinet. An adapter panel is attached to the structural panel. The adapter panel extends over at least a portion of an upper surface of the structural panel. A decorative panel is removably coupled to the adapter panel. The decorative panel is disposed over a top surface of the adapter panel. The decorative panel is free of attachment with the cabinet.

20 Claims, 3 Drawing Sheets

(56) References Cited

U.S. PATENT DOCUMENTS 5,983,808 A 11/1999 Weil
6,086,174 A * 7/2000 Graves ..... A47B 47/03 312/263
7,105,218 B1 * 9/2006 Klemm ..... A47L 15/4251 312/228
9,185,981 B1 * 11/2015 Kane ..... A47B 77/02
9,387,912 B2 * 7/2016 Lee ..... B61D 37/00
10,470,641 B2 * 11/2019 Chwalibog ..... A47L 15/4257
10,660,440 B2 * 5/2020 Rocamora ..... A47B 81/00
2003/0222547 A1 * 12/2003 Trees ..... A47B 77/00 312/204
2005/0000180 A1 * 1/2005 Yoon ..... E04F 13/0871 52/455
2006/0141197 A1 * 6/2006 Caparros Taracido ..... B32B 27/10 428/40.1
2006/0219693 A1 * 10/2006 Earls ..... G09F 7/02 219/399
2007/0018541 A1 * 1/2007 Hacker ..... E05G 1/02 312/204
2007/0022921 A1 * 2/2007 Perkins ..... B25H 3/00 108/64
2007/0151306 A1 * 7/2007 Gilboe ..... D06F 39/02 68/13 R
2008/0223085 A1 * 9/2008 Park ..... D06F 39/14 68/139
2009/0195130 A1 8/2009 Priego
2010/0107937 A1 5/2010 Sandrin
2011/0030188 A1 * 2/2011 Ciyanoglu ..... A47B 77/08 29/426.2
2011/0283632 A1 * 11/2011 Sutton ..... A47B 96/06 52/36.1
2012/0169192 A1 * 7/2012 Simon ..... A47B 96/20 312/228
2012/0169196 A1 * 7/2012 Marchetti ..... E06B 3/721 312/265.6
2013/0014546 A1 1/2013 Kobayashi et al.
2013/0337220 A1 * 12/2013 Janke ..... A47B 88/956 428/99
2016/0235201 A1 * 8/2016 Soot ..... F21V 33/0012
2017/0156499 A1 * 6/2017 Kane ..... A47B 96/20
2018/0010283 A1 * 1/2018 An ..... D06F 37/04
2020/0063412 A1 * 2/2020 Miller ..... A47B 96/20

FOREIGN PATENT DOCUMENTS

CN 108797053 A 11/2018
DE 4039508 A1 6/1991
DE 4240888 A1 6/1994
DE 19750946 A1 11/1998
FR 2673575 A1 9/1992
GB 2065460 B 8/1983
KR 20060109162 A 10/2006

* cited by examiner

TOP ATTACHMENT FOR A LAUNDRY APPLIANCE

CROSS-REFERENCE TO RELATED APPLICATIONS

This application claims priority to U.S. Provisional Application 62/786,095, filed on Dec. 28, 2018, entitled, "TOP ATTACHMENT FOR LAUNDRY APPLIANCE," the disclosure to which is hereby incorporated herein by reference in its entirety.

BACKGROUND OF THE DISCLOSURE

The present disclosure generally relates to a top attachment, and more specifically, to a decorative panel removably coupled to a laundry appliance.

SUMMARY OF THE DISCLOSURE

According to one aspect of the present disclosure, a laundry appliance includes a cabinet that has a top edge. A structural panel is attached to the top edge of the cabinet. An adapter panel is attached to the structural panel. The adapter panel extends over at least a portion of an upper surface of the structural panel. A decorative panel is removably coupled to the adapter panel. The decorative panel is disposed over a top surface of the adapter panel. The decorative panel is free of attachment with the cabinet.

According to another aspect of the present disclosure, a laundry appliance includes a cabinet that defines an opening and includes a top edge. A door is coupled to the cabinet and is operable between opened and closed positions relative to the opening. A structural panel is attached to the top edge of the cabinet. The structural panel defines at least one aperture for receiving a coupling member. An adapter panel is coupled to an upper surface of the structural panel. The adapter panel defines at least one receiving hole for receiving the coupling member. A decorative panel is disposed on a top surface of the adapter panel.

According to yet another aspect of the present disclosure, a decorative panel assembly for a laundry appliance includes a structural panel that defines a top panel of a cabinet. An adapter panel is coupled to the structural panel and forms a first attachment therebetween. The adapter panel extends over at least a substantial portion of a top surface of the structural panel. A decorative panel is selectively coupled to the adapter panel and forms a second attachment therebetween. The decorative panel extends over a top surface of the adapter panel. The decorative panel is selectively removable from the adapter panel. The first attachment is separated from the second attachment.

These and other features, advantages, and objects of the present disclosure will be further understood and appreciated by those skilled in the art by reference to the following specification, claims, and appended drawings.

Figure 1:
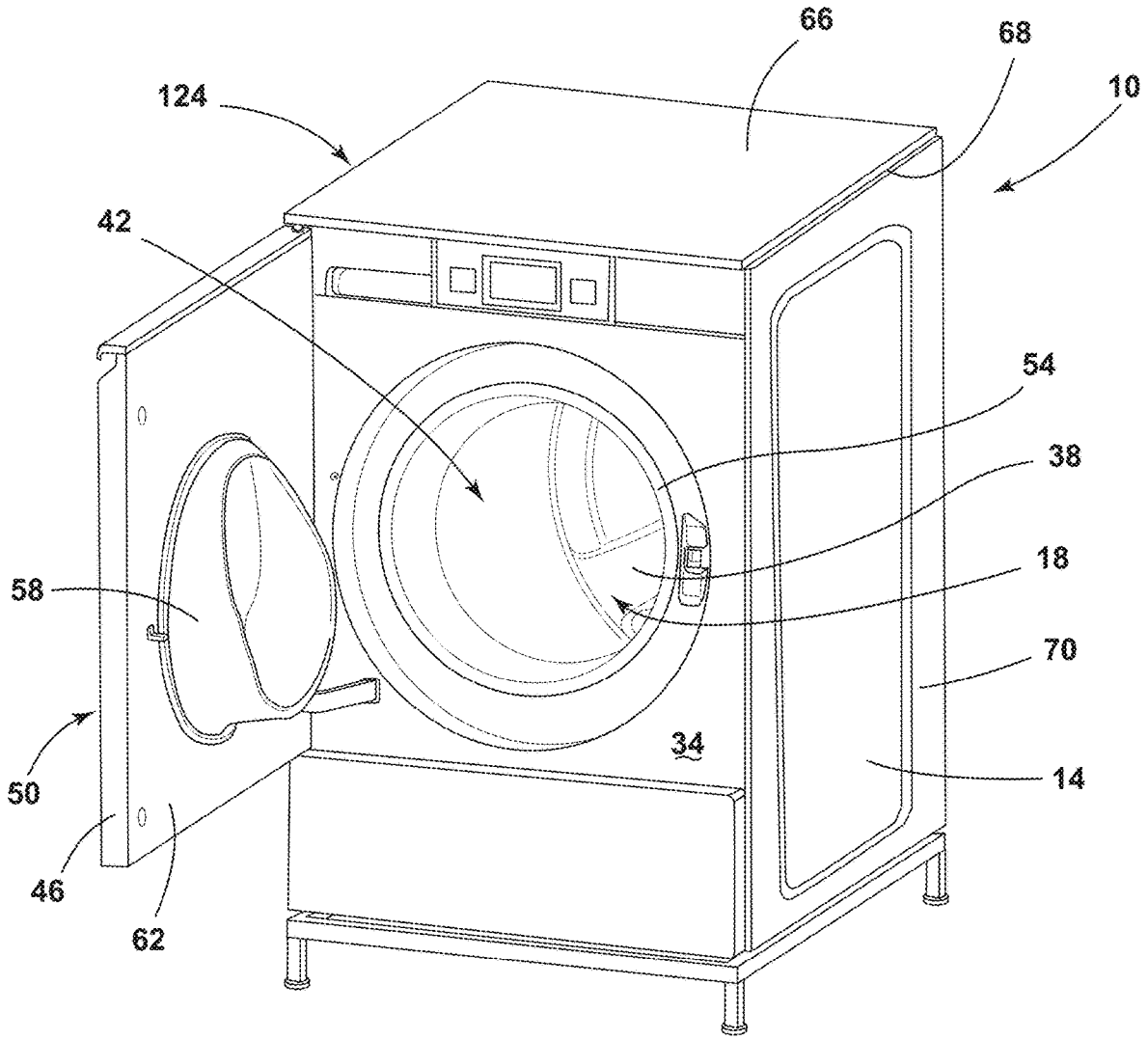
FIG. 1 is a front perspective view of a laundry appliance, according to at least one example.

The components in the figures are not necessarily to scale, emphasis instead being placed upon illustrating the principles described herein.

DETAILED DESCRIPTION

The present illustrated embodiments reside primarily in combinations of method steps and apparatus components related to a top attachment for a laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-5, reference numeral 10 generally designates a laundry appliance having a cabinet 14 that defines an opening 18. A structural panel 22 is coupled to the cabinet 14. An adapter panel 26 is coupled to the structural panel 22. A decorative panel 30 is coupled to the adapter panel 26.

Referring now to FIG. 1, the laundry appliance 10 is shown having the opening 18 defined by a front surface 34 of the cabinet 14. A drum 38 and/or a tub are positioned within the cabinet 14 based on the type of laundry appliance 10. The opening 18 allows access to an interior 42 of the drum 38. The laundry appliance 10 may be, for example, a washer, a dryer, or a combination washer/dryer. A front panel 46 of the laundry appliance 10 is coupled to the front surface 34 of the cabinet 14. The front panel 46 is advantageous for improving aesthetics of the laundry appliance 10. Additionally, the front panel 46 may be advantageous for coupling a door 50 to the laundry appliance 10. In various examples, the front panel 46 may operate as the door 50. The door 50 is operable between opened and closed positions relative to the opening 18 of the cabinet 14. As shown in the depicted example, the door 50 is a swing panel door.

In various examples, the laundry appliance 10 is a front load and/or horizontal-axis washer, which typically include a bellows assembly 54 positioned about a perimeter of the opening 18. In such examples, the door 50 may include a deflection member 58 coupled to an interior surface 62 of the door 50. The deflection member 58 directs laundry within the laundry appliance 10 away from the door 50 and/or the bellows assembly 54. The deflection member 58 is typically advantageous in horizontal-axis washers to protect the laundry and/or the bellows assembly 54. The laundry appliance 10 is illustrated as a front-load laundry appliance 10, but may also be a top-load laundry appliance 10 without significantly departing from the teachings herein.

Figure 2:
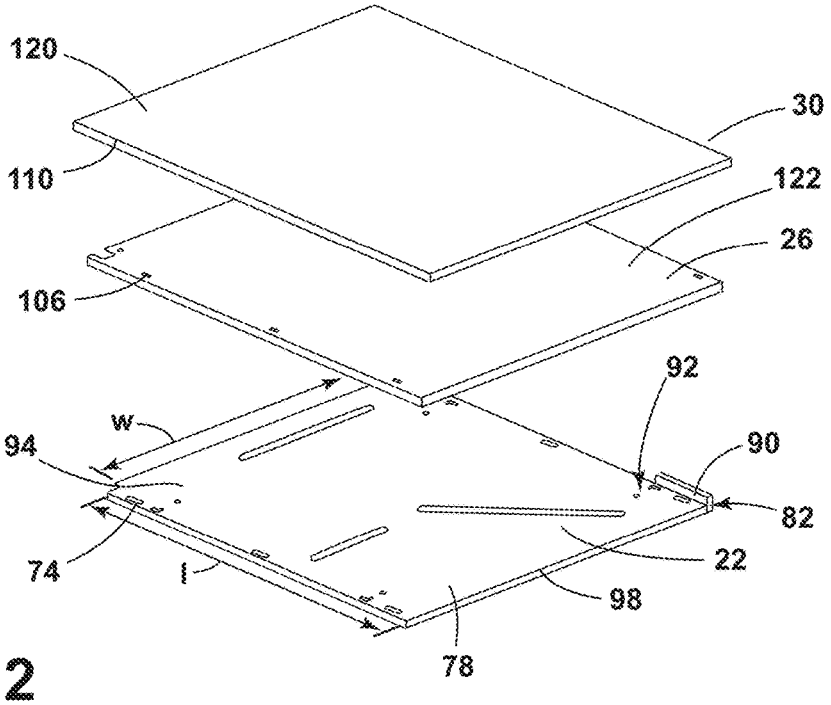
FIG. 2 is an exploded view of a structural panel, an adapter panel, and a decorative panel of a laundry appliance, according to at least one example.
Figure 3:
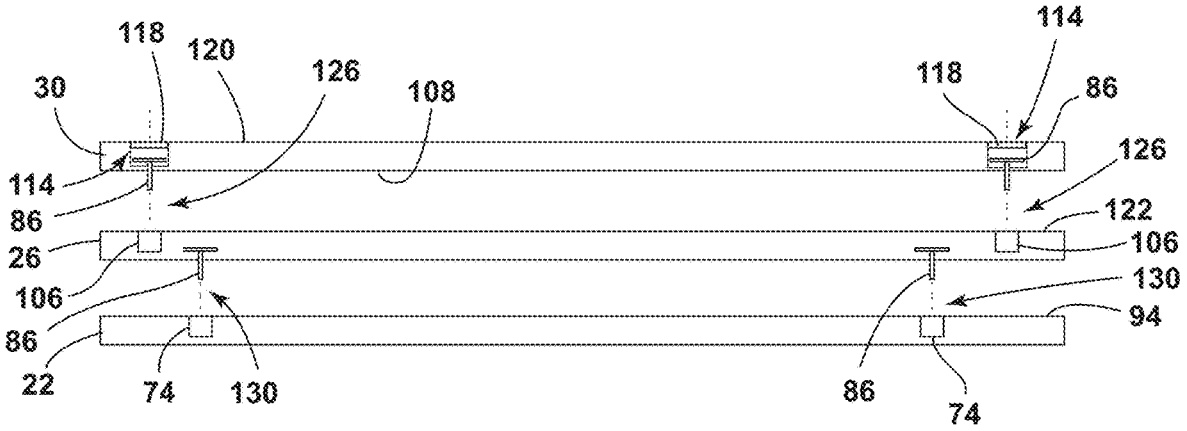
FIG. 3 is an exploded view of a first attachment coupling a decorative panel and an adapter panel and a second attachment coupling the adapter panel and a structural panel, according to at least one example.

Referring to FIGS. 1-3, the structural panel 22 is attached to the cabinet 14. Typically, the structural panel 22 is configured as a structural top panel coupled to a top edge 68 of the cabinet 14. The structural panel 22 provides additional strength, rigidity, and/or support to a top portion of the laundry appliance 10. The structural panel 22 may be made from, for example, plastics, polymers, metals, metal alloys, composite materials, combinations thereof, and/or other similar materials. In various examples, the structural panel 22 may be made from the same or substantially similar material as the cabinet 14 of the laundry appliance 10. The structural panel 22 forms a hard and/or a rigid top surface 66 of the laundry appliance 10. As such, the structural panel 22 is attached, or otherwise coupled, to each sidewall 70 of the laundry appliance 10.

In various examples, the structural panel 22 can be integrally formed with other outer panels of the cabinet 14, such that the structural panel 22 and the cabinet 14 are a single structure. Alternatively, the structural panel 22 is attached to the top edge 68 of the cabinet 14. In such examples, the structural panel 22 defines more than one aperture 74. The apertures 74 are typically positioned along an edge portion 78 of the structural panel 22. For example, each corner 82 of the structural panel 22 can include at least one aperture 74. The apertures 74 are configured to receive a coupling member 86 (FIG. 3) for coupling the structural panel 22 to the cabinet 14. The coupling member 86 may be, for example, screws, bolts, snap features, or other similar fastening mechanisms or methods. The structural panel 22 may additionally or alternatively be coupled to the cabinet 14 via adhesives or welding.

The structural panel 22 may include an edge extension 90 that extends upward from an upper surface 94 of the structural panel 22 and away from the cabinet 14. The edge extension 90 is coupled to the structural panel 22. According to various aspects, the edge extension 90 is configured as a tab, a flap, a flange, or other similar formation. Alternatively, the edge extension 90 can form a single integrated member with the structural panel 22. The edge extension 90 typically extends from at least one side 98 of the structural panel 22. According to various aspects, the edge extension 90 extends around a portion, or alternatively, an entire perimeter of the structural panel 22. The edge extension 90 defines a first receiving cavity 92. At least one of the adapter panel 26 and the decorative panel 30 is received within the receiving cavity 92. The edge extension 90 operates to hold and/or align the adapter panel 26 and/or the decorative panel 30. The edge extension 90 can also be advantageous for concealing the separate attachments between the structural panel 22 and the adapter panel 26, and/or the adapter panel 26 and the decorative panel 30.

Referring still to FIGS. 1-3, the adapter panel 26 is attached to the upper surface 94 of the structural panel 22. The adapter panel 26 extends over at least a substantial portion of the upper surface 94 of the structural panel 22. The adapter panel 26 is an intermediary between the structural panel 22 and the decorative panel 30. The adapter panel 26 typically extends an entire length "l" and width "w" of the structural panel 22. Accordingly, the adapter panel 26 can entirely cover the structural panel 22. Stated differently, the adapter panel 26 covers the entire upper surface 94 of the structural panel 22. The adapter panel 26 may be formed from, for example, a rigid panel of rubber, foam, coated material, or other similar rigid material. The coating material, where implemented, can include rubber, foam, gels, bituminous materials, or other similar coating materials. The adapter panel 26 may be formed from, or may include, sound-dampening and/or sound-deadening materials. The adapter panel 26 is advantageous for reducing sound and/or vibrations from the laundry appliance 10. According to various aspects, the adapter panel 26 is formed from a durable material, such that the decorative panel 30 is properly supported during use. Additionally or alternatively, the adapter panel 26 formed from a durable material is advantageous when shipping and/or transporting the laundry appliance 10. In this way, the decorative panel 30 can be removed to reduce damage and the exposed adapter panel 26 may withstand stress and/or force resulting from the shipping process.

The adapter panel 26 typically includes at least one receiving hole 106. The receiving holes 106 are configured to align and correspond with the apertures 74 of the structural panel 22. The adapter panel 26 is selectively coupled to the structural panel 22 via the coupling members 86. The coupling member 86 may be, for example, screws, bolts, snap features, or other similar fastening mechanisms or methods. Typically, one set of coupling members 86 is used to couple the structural panel 22 to the cabinet 14 and a second set of coupling members 86 is used to couple the adapter panel 26 to the structural panel 22. According to various aspects, a single type of coupling members 86 may be used to couple the structural panel 22 and the adapter panel 26, as well as the adapter panel 26 and the decorative panel 30 to the cabinet 14. Additionally or alternatively, the adapter panel 26 may be coupled to the structural panel 22 via adhesives or welding.

Referring again to FIGS. 1-3, the decorative panel 30 is coupled to a top surface 122 of the adapter panel 26. The decorative panel 30 at least extends the entire length "l" and width "w" of the structural panel 22. In various examples, the decorative panel 30 has a greater length and width than the adapter panel 26 to cover and/or obscure the adapter panel 26 and the structural panel 22. It is advantageous for the decorative panel 30 to cover the entire top surface 122 of the adapter panel 26 and/or the entire upper surface 94 of the structural panel 22 to improve aesthetics of the laundry appliance 10. In this way, the structural panel 22 and the adapter panel 26 can be substantially, or entirely, obscured from view of a user proximate the laundry appliance 10.

Typically, the decorative panel 30 is advantageous to hide, conceal, and/or camouflage the laundry appliance 10 within a cabinetry setting and/or in relation to surrounding countertops. In this way, the decorative panel 30 may have similar coloring, design, and/or other aesthetic qualities that correspond with the surrounding cabinetry setting and/or countertops. For example, in cabinetry settings, the decorative panel 30 can have a wood-grain design that substantially corresponds with a wood-grain of the cabinetry. In another non-limiting example, when the laundry appliance 10 is disposed adjacent to countertops, the decorative panel 30 can have a design and/or be formed from a material that substantially mirrors the countertop materials (e.g., plastic, vinyl, granite, quartz, etc.), such that the laundry appliance 10 appears as a continuous extension of the countertop. Additionally or alternatively, the decorative panel 30 may be painted, stained, or include other similar design elements. The decorative panel 30 provides for a unique and customizable aesthetic appearance of the laundry appliance 10 that can blend in or stand out from the surroundings.

According to various aspects, the decorative panel 30 is removably and/or selectively coupled to the laundry appliance 10. The removable decorative panel 30 is advantageous to reduce the risk of damage to the decorative panel 30 when shipping the laundry appliance 10. The decorative panel 30 is coupled to the adapter panel 26 by the coupling members 86. The coupling members 86 may be, for example, screws, bolts, snap features, or other similar fastening mechanisms or methods. In various examples, the coupling members 86 are snap features that extend downward from a bottom surface 108 of the decorative panel 30. This configuration may be advantageous for selectively coupling the decorative panel 30 to the laundry appliance 10 without the use of tools. It is contemplated that the snap features are configured to cooperate with the cabinet 14, the structural panel 22, and/or the adapter panel 26 to couple the decorative panel 30 to the laundry appliance 10. In such examples, the snap features extend from an outer edge 110 and/or the bottom surface 108 of the decorative panel 30 to couple to the adapter panel 26. In this way, the snap features extend over, and obscure, edges of the adapter panel 26 and/or the structural panel 22.

In various examples, the decorative panel 30 typically defines at least one recess 114 configured to align and correspond with the receiving holes 106 of the adapter panel 26. In this way, the coupling member 86 is disposed in the recess 114 and extends through the receiving hole 106 of the adapter panel 26. The decorative panel 30 is typically coupled only to the adapter panel 26. In this way, the decorative panel 30 is free from attachment with the cabinet 14. Typically, a third set of coupling members 86 couples the decorative panel 30 to the adapter panel 26. In this way, the decorative panel 30 can be removed from the laundry appliance 10 without removing the adapter panel 26 from the structural panel 22 and/or the structural panel 22 from the cabinet 14. Other combinations of coupling the cabinet 14, the structural panel 22, the adapter panel 26, and the decorative panel 30 are contemplated without departing from the teachings herein. In certain aspects of the device, the coupling members 86 can be formed, set, adhered, or otherwise disposed within the decorative panel 30 and extend downward from the bottom surface 108 to engage and connect with the adapter panel 26.

Referring still to FIGS. 1-3, in various examples, where the recess 114 is exposed to the top surface 120 of the decorative panel 30, at least one decorative inlay 118 is used to fill and/or cover the recesses 114 in an outer top surface 120 of the decorative panel 30. The decorative inlay 118 may be advantageous to improve the aesthetics of the laundry appliance 10 by creating a uniform surface over a top portion 124 of the laundry appliance 10 or by creating a unique and customizable aesthetic appearance of the decorative panel 30. Stated differently, the decorative inlay 118 is flush with the outer top surface 120 of the decorative panel 30 to form a continuous outer top surface 120. Use of the decorative panel 30 and/or the decorative inlay 118 can obfuscate the appearance of the laundry appliance 10 within a cabinetry setting.

The decorative panels 30 may be formed from, for example, metals or metal alloys. In such examples, the decorative panel 30 may be made from the same, or substantially similar, material as the cabinet 14 and/or the structural panel 22. The decorative panel 30 may also be formed from, for example, rubber. In such examples, the decorative panel 30 may be formed from the same, or substantially, similar material as the adapter panel 26. The decorative panel 30 can increase the sound-dampening and/or sound-deadening effects of the adapter panel 26. In various examples, the decorative panel 30 may be formed from plastics, ceramics, or glass. In such examples, the decorative panel 30 can improve aesthetics of the laundry appliance 10. The decorative panel 30 may also be formed of stone, solid surface, wood, cement, combinations thereof, and/or other similar finish-type materials. The decorative panel 30 formed of a finish-type material can be advantageous to camouflage or minimize the appearance of the laundry appliance 10 among surrounding countertops and/or cabinetry.

The decorative panel 30 may include designs, artwork, wording, and/or patterns across an outer top surface 120 to increase the aesthetics of the laundry appliance 10. The decorative panel 30 may additionally or alternatively include sayings, quotes, or instructions on the outer top surface 120.

The decorative panel 30 can be exchanged and/or changed by a consumer. Using the coupling members 86, the decorative panel 30 conveniently couples to and/or uncouples from the laundry appliance 10 to allow a consumer to change the decorative panel 30, and therefore, change the aesthetics of the laundry appliance 10 whenever desired by the consumer, without purchasing an entirely new appliance.

Referring now to FIG. 3, a first attachment 126 couples the decorative panel 30 with the adapter panel 26. Stated differently, the first attachment 126 is defined between the decorative panel 30 and the adapter panel 26. The first attachment 126 typically includes the coupling members 86 in the recesses 114 of the decorative panel 30 that correspond with the receiving holes 106 of the adapter panel 26. A second attachment 130 attaches the adapter panel 26 to the structural panel 22. Stated differently, the second attachment 130 is defined between the adapter panel 26 and the structural panel 22. The second attachment 130 typically includes the coupling members 86 of the adapter panel 26 that correspond with the apertures 74 of the structural panel 22. The first attachment 126 is offset or misaligned from the second attachment 130. Stated differently, the first attachment 126 is separated from the second attachment 130. It is advantageous to offset or misalign the first and second attachments 126, 130 to increase the structural integrity of the adapter panel 26.

Figure 4:
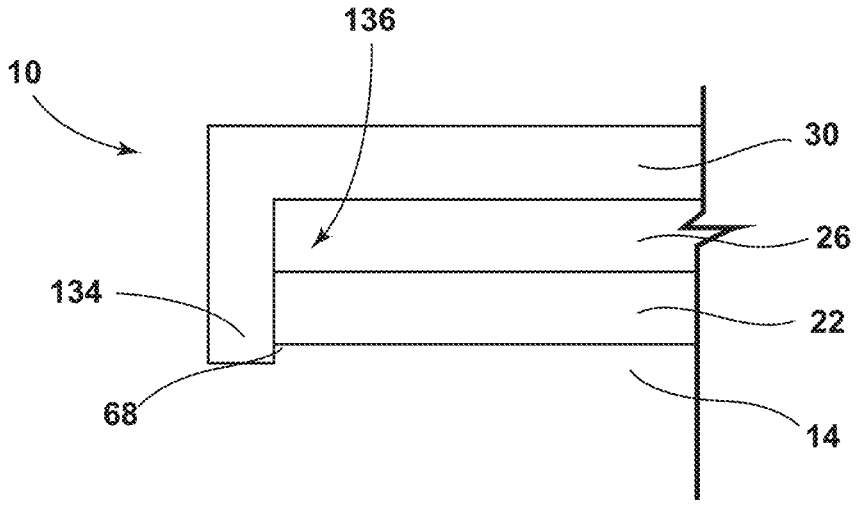
FIG. 4 is a partial rear elevational view of the decorative panel that has a border member assembled with a cabinet, according to at least one example.

Referring to FIG. 4, the decorative panel 30 may include a border member 134 that extends vertically therefrom. The border member 134 extends from all or a portion of a perimeter of the decorative panel 30. In particular, the front and opposing sides of the perimeter of the decorative panel 30. The border member 134 extends downward towards the cabinet 14 and typically operates to conceal at least the adapter panel 26 and typically the structural panel 22 from the view of a consumer. The border member 134 defines a concealing cavity 136. The adapter panel 26, the structural panel 22, and/or at least a portion of the cabinet 14 are disposed within the concealing cavity 136 when the decorative panel 30 is assembled with the cabinet 14. In this way, the border member 134 conceals the adapter panel 26 and/or the structural panel 22. In various examples, an end of the border member 134 aligns with and/or be disposed proximate to the top edge 68 of the cabinet 14. The border member 134 can increase the aesthetics of the laundry appliance 10 by concealing less decorative features (e.g., the structural panel 22 and/or the adapter panel 26) with the more aesthetic decorative panel 30. The border member 134 additionally conceals the first and second attachments 126, 130 (FIG. 3) and therefore increase the aesthetics of the laundry appliance 10. The border member 134 aligns the adapter panel 26 and/or the structural panel 22. In this way, at least one of the adapter panel 26 and the structural panel 22 abuts the border member 134.

Figure 5:
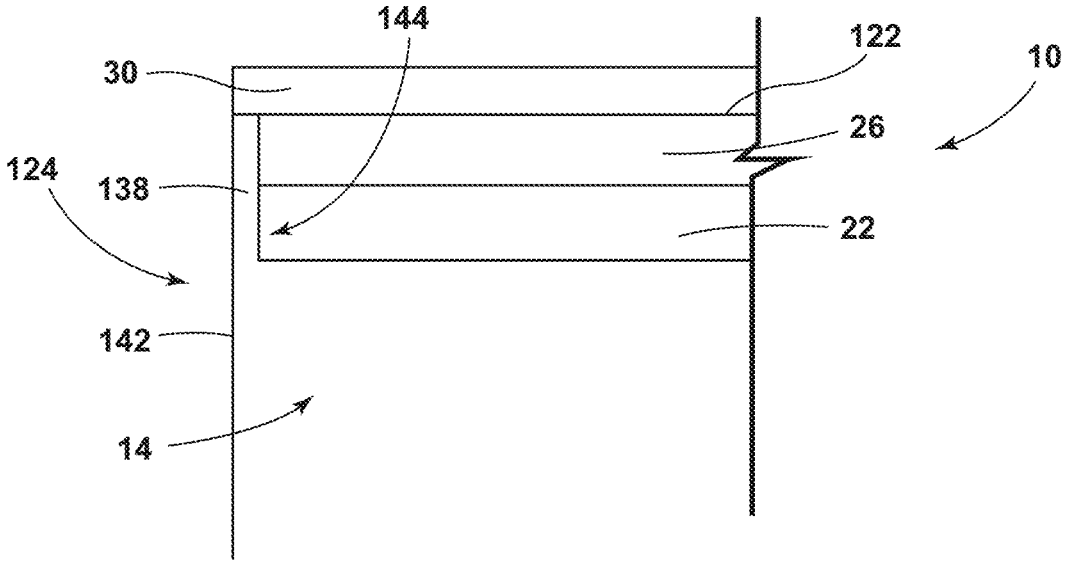
FIG. 5 is a partial rear elevational view of a locating flange of a cabinet with a decorative panel assembled on the cabinet, according to at least one example.

Referring to FIG. 5, the cabinet 14 may include a locating flange 138 that extends upwards from a side panel 142 of the cabinet 14. The cabinet 14 and the locating flange 138 form a second receiving cavity 144 proximate the top portion 124 of the laundry appliance 10. Similar to the border member 134 (FIG. 4) discussed above, the locating flange 138 conceals the adapter panel 26 and/or the structural panel 22. Moreover, the locating flange 138 conceals the first and second attachments 126, 130 (FIG. 3). In this way, the locating flange 138 typically increases the aesthetics of the laundry appliance 10 by concealing less decorative features (e.g., the structural panel 22 and/or the adapter panel 26). Accordingly, the locating flange 138 extends upward, such that an end of the locating flange 138 is typically disposed proximate the bottom surface 108 of the decorative panel 30. According to various aspects, the locating flange 138 abuts the bottom surface 108 of the decorative panel 30. In this way, the decorative panel 30 extends over the locating flange 138 to provide for a continuous appearance of the side panel 142 of the laundry appliance 10. The locating flange 138 may assist in aligning the structural panel 22 and/or the adapter panel 26, as well as, increase the aesthetics of the laundry appliance 10 by concealing the structural panel 22 and/or the adapter panel 26. Additionally or alternatively, in various examples, a sealant may be positioned proximate the locating flange 138 to prevent the infiltration of water into the cabinet 14.

Use of the present disclosure provides for a variety of advantages. For example, one goal of the present disclosure is to provide for a laundry appliance 10 that can be located within a common area or within a smaller residence that may not include a dedicated laundry or utility room. The decorative panel 30 can be selectively coupled to the adapter panel 26 and can provide a consumer with the ability to disguise or conceal the laundry appliance 10. Additionally, the decorative panel 30 can be customizable by the consumer. In this way, the appearance of the laundry appliance 10 can be customizable to the consumer. Further, the decorative panel 30 can be selectively coupled to the laundry appliance 10. As such, the consumer can uncouple the decorative panel 30 and couple a different decorative panel 30 to the laundry appliance 10 to change the appearance of the laundry appliance 10. Moreover, the decorative panel 30 is typically removed for shipping of the laundry appliance 10, which can be advantageous for reducing damage during the shipping process. Additionally, the structural panel 22 and the adapter panel 26, by having a separate attachment 130, can be installed on the appliance 10 to remain in place for the life of the appliance 10. The decorative panel 30, because of the separate attachment points 126, can be installed, removed, replaced, and reinstalled without disturbing the integrity of the structural and adapter panels 22, 26. The adapter panel 26 also provides a cushioned or flexible surface upon which the decorative panel 30 can be placed to minimize the changes of denting, scratching, or other damage to the cabinet 14. Additional benefits and advantages of using this device may also be realized and/or achieved.

According to at least one aspect, a laundry appliance includes a cabinet including a top edge. A structural panel is attached to the top edge of the cabinet. An adapter panel is attached to the structural panel. The adapter panel extends over at least a portion of an upper surface of the structural panel. A decorative panel is removably coupled to the adapter panel. The decorative panel is disposed over a top surface of the adapter panel. The decorative panel is free of attachment with the cabinet.

According to another aspect, a cabinet includes a locating flange that extends vertically upward from a top edge to align a structural panel with a top edge of the cabinet.

According to another aspect, an end of a locating flange aligns with a bottom surface of a decorative panel when a decorative panel is assembled with a cabinet.

According to another aspect, a decorative panel includes at least one snap feature that extends from a bottom surface thereof to couple to the adapter panel.

According to another aspect, a decorative panel includes a border member that extends from at least a portion of a perimeter toward a cabinet when the decorative panel is assembled on the cabinet. The border member defines a concealing cavity.

According to another aspect, an adapter panel and at least a portion of a cabinet are disposed in a concealing cavity when assembled.

According to another aspect, a decorative panel includes at least one of a design, a pattern, wording, and artwork.

According to at least one aspect, a laundry appliance includes a cabinet that defines an opening and includes a top edge. A door is coupled to the cabinet and is operable between opened and closed positions relative to the opening. A structural panel is attached to the top edge of the cabinet. The structural panel defines at least one aperture for receiving a coupling member. An adapter panel is coupled to an upper surface of the structural panel. The adapter panel defines at least one receiving hole for receiving the coupling member. A decorative panel is disposed on a top surface of the adapter panel.

According to another aspect, a decorative panel has a length and a width greater than a length and a width of an adapter panel.

According to another aspect, a decorative panel defines at least one recess for receiving a coupling member.

According to another aspect, at least one decorative inlay is disposed in at least one recess.

According to another aspect, a decorative panel includes a border member that extends from at least a portion of a perimeter toward a cabinet when the decorative panel is assembled with the cabinet.

According to another aspect, at least one of an adapter panel and a structural panel abuts a border member of the decorative panel.

According to another aspect, an end of the border member aligns with the top edge of the cabinet when a decorative panel is assembled with the cabinet.

According to at least one aspect, a decorative panel assembly for a laundry appliance includes a structural panel that defines a top panel of a cabinet. An adapter panel is coupled to the structural panel and forms a first attachment therebetween. The adapter panel extends over at least a substantial portion of an upper surface of the structural panel. A decorative panel is selectively coupled to the adapter panel and forms a second attachment therebetween. The decorative panel extends over a top surface of the adapter panel. The decorative panel is selectively removable from the adapter panel. The first attachment is separated from the second attachment.

According to another aspect, a first attachment is defined by a coupling member that extends through a recess defined by the decorative panel and a receiving hole defined by the adapter panel.

According to another aspect, a decorative inlay is disposed within a recess forming a continuous outer top surface of a decorative panel.

According to another aspect, a second attachment is defined by a coupling member that extends through a receiving hole defined by an adapter panel and an aperture defined by a structural panel.

According to another aspect, first and second attachments are offset from one another.

According to another aspect, a decorative panel has a length and a width greater than a length and a width of an adapter panel.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet including a first sidewall and a second sidewall, each of the first sidewall and the second sidewall having a top edge, wherein the first sidewall opposes the second sidewall;

a structural panel attached to the top edge of the first sidewall and the second sidewall of the cabinet;

an adapter panel attached to the structural panel, wherein the adapter panel extends over at least a portion of an upper surface of the structural panel; and a decorative panel removably coupled to the adapter panel, wherein the decorative panel extends from the first sidewall to the second sidewall and is disposed over a top surface of the adapter panel, and wherein the decorative panel is free of a direct attachment with the cabinet.

2. The laundry appliance of claim 1, wherein the cabinet includes a locating flange extending vertically upward from the top edge to align the structural panel with the top edge of the cabinet.

3. The laundry appliance of claim 1, wherein the decorative panel includes at least one snap feature extending from a bottom surface thereof to couple to the adapter panel.

4. The laundry appliance of claim 1, wherein the decorative panel includes a border member extending from at least a portion of a perimeter toward the cabinet when the decorative panel is assembled on the cabinet, and wherein the border member defines a concealing cavity.

5. The laundry appliance of claim 4, wherein the adapter panel and at least a portion of the cabinet are disposed in the concealing cavity when assembled.

6. The laundry appliance of claim 1, wherein the decorative panel includes at least one of a design, wording, artwork, and pattern.

7. The laundry appliance of claim 1, wherein the cabinet includes a third sidewall and a fourth sidewall opposing the third sidewall, and wherein the decorative panel extends from the third sidewall to the fourth sidewall.

8. A laundry appliance, comprising:

a cabinet defining a front opening, wherein the cabinet includes sidewalls, and wherein each sidewall includes a top edge;

a door coupled to the cabinet and operable between opened and closed positions relative to the front opening;

a structural panel attached to the top edge of each sidewall of the cabinet, wherein the structural panel defines at least one aperture for receiving a coupling member;

an adapter panel coupled to an upper surface of the structural panel, wherein the adapter panel defines at least one receiving hole for receiving the coupling member; and a decorative panel disposed on a top surface of the adapter panel, wherein the decorative panel extends at least partially over the top edge of each sidewall.

9. The laundry appliance of claim 8, wherein the decorative panel has a length and a width greater than a length and a width of the adapter panel.

10. The laundry appliance of claim 8, wherein the decorative panel defines at least one recess for receiving the coupling member.

11. The laundry appliance of claim 10, further comprising:

at least one decorative inlay disposed in the at least one recess.

12. The laundry appliance of claim 8, wherein the decorative panel includes a border member extending from at least a portion of a perimeter toward the cabinet when the decorative panel is assembled with the cabinet.

13. The laundry appliance of claim 12, wherein at least one of the adapter panel and the structural panel abuts the border member of the decorative panel.

14. The laundry appliance of claim 12, wherein an end of the border member aligns with the top edge of the cabinet when the decorative panel is assembled with the cabinet.

15. A decorative panel assembly for a laundry appliance, comprising:

a structural panel defining a top panel of a cabinet, wherein the structural panel is configured to extend from a first sidewall to an opposing second sidewall and from a third sidewall to an opposing fourth sidewall of the cabinet;

an adapter panel coupled to the structural panel and forming a first attachment therebetween, wherein the adapter panel extends over at least a substantial portion of an upper surface of the structural panel; and a decorative panel selectively coupled to the adapter panel and forming a second attachment therebetween, wherein the decorative panel extends over a top surface of the adapter panel and is configured to extend from the first sidewall to the opposing second sidewall and from the third sidewall to the opposing fourth sidewall of the cabinet, wherein the decorative panel is selectively removable from the adapter panel, and wherein the first attachment is separated from the second attachment.

16. The decorative panel assembly of claim 15, wherein the second attachment is defined by a coupling member extending through a recess defined by the decorative panel and a receiving hole defined by the adapter panel.

17. The decorative panel assembly of claim 16, further comprising:

a decorative inlay disposed within the recess forming a continuous outer top surface of the decorative panel.

18. The decorative panel assembly of claim 15, wherein the first attachment is defined by a coupling member extending through a receiving hole defined by the adapter panel and an aperture defined by the structural panel.

19. The decorative panel assembly of claim 15, wherein the first and second attachments are offset from one another.

20. The decorative panel assembly of claim 15, wherein the decorative panel has a length and a width greater than a length and a width of the adapter panel.

* * * * *